US009224553B2

(12) United States Patent
Chiang

(10) Patent No.: US 9,224,553 B2
(45) Date of Patent: Dec. 29, 2015

(54) KEYSWITCH HAVING A SLIDABLE TRANSLATION MECHANISM

(71) Applicants: DARFON ELECTRONICS (SUZHOU) CO., LTD., Suzhou, Jiangsu Province (CN); DARFON ELECTRONICS CORP., Taoyuan (TW)

(72) Inventor: Tzu-Pang Chiang, Taoyuan (TW)

(73) Assignees: DARFON ELECTRONICS (SUZHOU) CO., LTD., New District, Suzhou, Jiangsu Province (CN); DARFON ELECTRONIC CORP., Gueishan, Taoyuan (TW)

( * ) Notice: Subject to any disclaimer, the term of this patent is extended or adjusted under 35 U.S.C. 154(b) by 0 days.

(21) Appl. No.: 14/298,964

(22) Filed: Jun. 9, 2014

(65) Prior Publication Data

US 2014/0367236 A1 Dec. 18, 2014

(30) Foreign Application Priority Data

Jun. 14, 2013 (TW) ..... 102121140 A

(51) Int. Cl.
*H01H 13/70* (2006.01)
*H01H 13/705* (2006.01)

(52) U.S. Cl.
CPC ..... *H01H 13/705* (2013.01); *H01H 2221/026* (2013.01); *H01H 2221/04* (2013.01); *H01H 2227/036* (2013.01)

(58) Field of Classification Search
CPC ..... H01H 3/12; H01H 2227/028; H01H 2227/03; H01H 2227/032; H01H 2227/034; H01H 2227/036
USPC ..... 200/344, 529, 533, 5 A; 345/168
See application file for complete search history.

(56) References Cited

U.S. PATENT DOCUMENTS

| | | | | |
|---|---|---|---|---|
| 5,626,223 | A * | 5/1997 | Lee | H01H 13/20 200/341 |
| 8,309,870 | B2 | 11/2012 | Peterson | |
| 8,847,890 | B2 | 9/2014 | Peterson | |
| 9,117,599 | B2 * | 8/2015 | Chen | H01H 3/12 |
| 2012/0268384 | A1 | 10/2012 | Peterson | |

(Continued)

FOREIGN PATENT DOCUMENTS

| | | | |
|---|---|---|---|
| CN | 102237215 | A | 11/2011 |
| TW | M464732 | U | 11/2013 |

*Primary Examiner* — Vanessa Girardi
(74) *Attorney, Agent, or Firm* — Winston Hsu; Scott Margo

(57) ABSTRACT

A keyswitch structure includes a keycap having a vertical connection member and a vertical-horizontal-translation mechanism, a baseplate having a vertical connection member, a slidable part having a vertical-horizontal-translation mechanism, and a restoring member. The vertical connection members are engaged for constraining the keycap to move relative to the baseplate substantially along a Z axis. The vertical-horizontal-translation mechanisms are engaged, so that the slidable part can perform a motion in response to a movement of the keycap toward the baseplate along the Z axis upon a pressing operation. The motion includes a displacement in a first direction. When the pressing operation is discontinued, a horizontal restoring force by the restoring member enables the slidable part to perform a motion that includes a displacement in a second direction to move the keycap away from the baseplate along the Z axis. The second direction is opposite to the first direction.

16 Claims, 10 Drawing Sheets

(56) References Cited

U.S. PATENT DOCUMENTS

2014/0151204 A1 6/2014 Chen
2014/0224632 A1 8/2014 Chen
2014/0262717 A1 9/2014 Krumpelman
2014/0311881 A1 10/2014 Krumpelman

* cited by examiner

KEYSWITCH HAVING A SLIDABLE TRANSLATION MECHANISM

BACKGROUND OF THE INVENTION

1. Field of the Invention

The invention relates to a keyswitch structure, and especially relates to a keyswitch structure, of which a keycap moves vertically along a Z axis, of which a guiding part disposed underneath the keycap. The guiding part slides toward (1) a first direction in response to a downward movement of the keycap, and (2) a direction opposite to the first direction in response to a horizontal restoring force.

2. Description of the Prior Art

A conventional keyswitch structure usually uses a resilient part to provide a restoring force to drive a keycap to move upward after a pressing thereon is discontinued, and also uses a scissors supporting mechanism to provide a necessary lift stability to the keycap. However, as demands for lightness and thinness become higher, the reduction in size to the conventional keyswitch structure reaches an ultimate limitation due to the dimension of the resilient part and the scissors supporting mechanism. Furthermore, when assembling the scissors supporting mechanism in the conventional keyswitch, four bearing ends of the scissors supporting mechanism need to be connected to the keycap and baseplate respectively, leading to much difficulty to the assembly.

In addition, how to maintain a familiar buckle tactile feedback to users even under the demands for lightness and thinness also is a key course of research and development in the conventional keyswitch structure.

SUMMARY OF THE INVENTION

An objective of the invention is to provide a keyswitch structure, which provides stable up-and-down movement and is easy to assemble.

Another objective of the invention is to provide a keyswitch structure, which uses a vertical-horizontal-translation design so that vertical and horizontal movements of a keycap can be transferred to each other so that the whole height of the keyswitch structure can be reduced efficiently and the assembly of the keyswitch structure can be simplified.

Another objective of the invention is to provide a keyswitch structure, which constrains a keycap thereof to vertically move relative to a baseplate of the keyswitch structure by a vertical structural integration so that a pressing habit of users still can be satisfied even under the effect of the reduction of the height of the keyswitch structure.

Another objective of the invention is to provide a keyswitch structure, which uses magnetic force instead of a disposition of a resilient part so that the structure of the keyswitch structure can be simplified and the size of the keyswitch structure can be reduced. In an embodiment, the keyswitch structure of the invention includes a keycap, a baseplate, a slidable part, and a restoring member. The keycap is used for receiving a pressing operation and includes a first vertical connection member and a first vertical-horizontal-translation mechanism. The baseplate is disposed beneath the keycap and includes a second vertical connection member. The second vertical connection member is engaged with the first vertical connection member so that the keycap is constrained to move relative to the baseplate substantially along a Z axis. The slidable part is disposed between the keycap and the baseplate. The slidable part includes a second vertical-horizontal-translation mechanism. The second vertical-horizontal-translation mechanism is engaged with the first vertical-horizontal-translation mechanism so that the slidable part performs a first motion in response to a movement of the keycap toward the baseplate along the Z axis upon the pressing operation. Therein, the first motion includes a displacement in a first direction. The restoring member is disposed at a side of the slidable part. The restoring member is used for providing at least a horizontal restoring force to the slidable part. When the pressing operation is discontinued, the horizontal restoring force enables the slidable part to perform a second motion. Therein, the second motion includes a displacement in a second direction to move the keycap away from the baseplate. Therein, the second direction is opposite to the first direction.

In an embodiment, the first vertical-horizontal-translation mechanism includes a first slanted surface. The second vertical-horizontal-translation mechanism includes a second slanted surface. The first slanted surface movably abuts against the second slanted surface, so that the movement of the keycap along the Z axis toward the baseplate can drive the slidable part to move toward the first direction, or a movement of the slidable part toward the second direction can drive the keycap to move away from the baseplate.

In an embodiment, the first vertical-horizontal-translation mechanism includes at least one slanted passage or at least one slanted post, while the second vertical-horizontal-translation mechanism correspondingly includes the at least one slanted post or the at least one slanted passage. The slanted post corresponds to the slanted passage. By the slanted post relatively moving in the slanted passage, vertical movements of the keycap and horizontal movements of the slidable part can be transferred to each other.

In an embodiment, the keycap is a substantial quadrilateral. The keycap has a first edge and a second edge adjacent to the first edge. Therein, an X axis is substantially parallel to the first edge of the keycap. A Y axis is substantially parallel to the second edge of the keycap. When the keycap receives the pressing operation so that the keycap moves toward the baseplate along the Z axis, the first motion includes the displacement in a positive direction of the X axis and a displacement in a positive direction of the Y axis. When the pressing operation is discontinued, the second motion includes the displacement in a negative direction of the X axis and a displacement in a negative direction of the Y axis. Therein, the negative direction of the X axis and the positive direction of the X axis are opposite directions along the X axis; the negative direction of the Y axis and the positive direction of the Y axis are opposite directions along the Y axis.

In an embodiment, the first vertical-horizontal-translation mechanism includes a first curved surface. The second vertical-horizontal-translation mechanism includes a second curved surface. By the first curved surface keeping contacting the second curved surface, vertical movements of the keycap and horizontal movements of the slidable part can be transferred to each other.

In an embodiment, one of the first curved surface and the second curved surface is a curved convex surface while the other one of the first curved surface and the second curved surface is a curved concave surface. Therein, the radius of curvature of the curved convex surface is smaller than the radius of curvature of the curved concave surface.

In an embodiment, the restoring member includes a plurality of magnetic parts. Magnetic force between the magnetic parts drives the slidable part to perform the second motion. Furthermore, the keyswitch structure of the invention further includes a frame. Therein, the restoring member includes a first magnetic part and a second magnetic part. The second magnetic part is disposed on the slidable part. The first magnetic part is disposed on the frame.

In an embodiment, the frame has a first key opening. Therein, the first key opening has a first side wall. The first key opening is enclosed by a first side wall. The keycap moves toward or away from the baseplate in the first key opening. The first magnetic part has a first end and a second end. The first end is exposed out on the first side wall. In another embodiment, the frame further has a second key opening. Therein, the second key opening is enclosed by a first side wall. The first key opening is next to the second key opening. The second end is exposed out on the second side wall.

In an embodiment, the frame further includes a first positioning portion facing the first key opening. The keycap further includes a second positioning portion slidably coupled to the first positioning portion. When the keycap moves toward or away from the baseplate, the second positioning portion moves relative to the first positioning portion.

In an embodiment, the baseplate includes a constraint portion. The slidable part includes an engagement portion movably engaged with the constraint portion. Therein, the constraint portion defines a movement range of the slidable part along the first and second directions. In an embodiment, the keycap has a first contact surface as the first vertical connection member, while the constraint portion has a second contact surface as the second vertical connection member. The second contact surface extends toward the keycap substantially along the Z axis. When the keycap moves substantially along the Z axis, the first contact surface keeps movably contacting the second contact surface. In another embodiment, the first vertical connection member has a first contact surface extending from the keycap substantially along the Z axis. The second vertical connection member has a second contact surface. When the keycap moves substantially along the Z axis, the first contact surface keeps movably contacting the second contact surface.

Furthermore, in an embodiment, the keyswitch structure of the invention further includes at least one a link. The link is rotatably connected to the keycap and the baseplate so that the keycap is maintained parallel to an XY plane during the keycap moving along the Z axis. Therein, the XY plane is parallel to the X axis and the Y axis. In an embodiment, the keyswitch structure of the invention further includes a switch layer. The switch layer is disposed between the slidable part and the baseplate. The switch layer is used for enabling the keyswitch structure in response to the pressing operation on the keycap.

These and other objectives of the present invention will no doubt become obvious to those of ordinary skill in the art after reading the following detailed description of the preferred embodiment that is illustrated in the various figures and drawings.

DETAILED DESCRIPTION

The invention provides a keyswitch structure capable of being applied to any press input device such as keyboard, reduces the height of keys of the keyswitch structure effectively, simplifies the assembly complexity of the keyswitch structure, and can satisfy user's pressing habits. Referring to the figures, the following will describe structure and operation of components of the keyswitch structure of the invention in detail.

Figure 1:
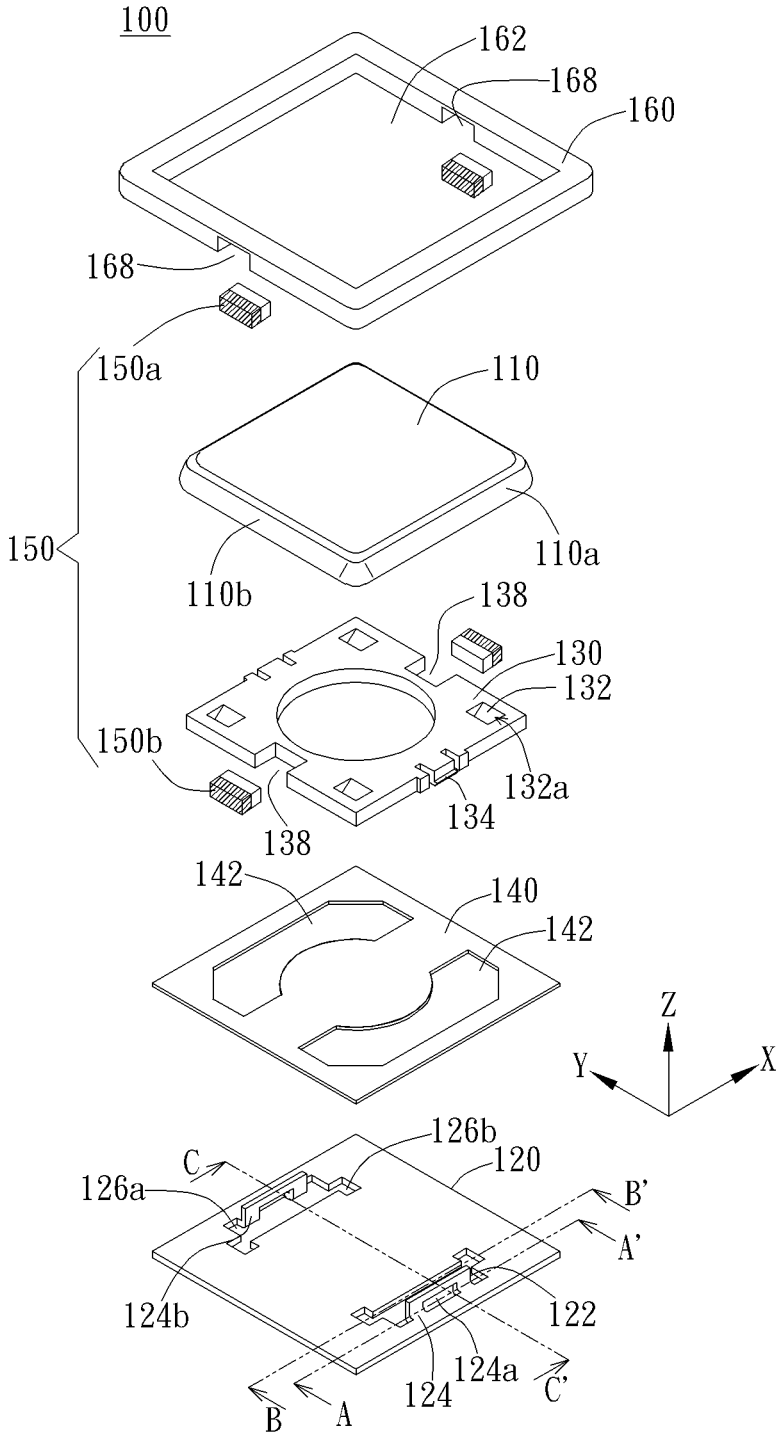
FIG. 1 is an exploded view of a keyswitch structure of an embodiment of the invention.
Figure 2A:
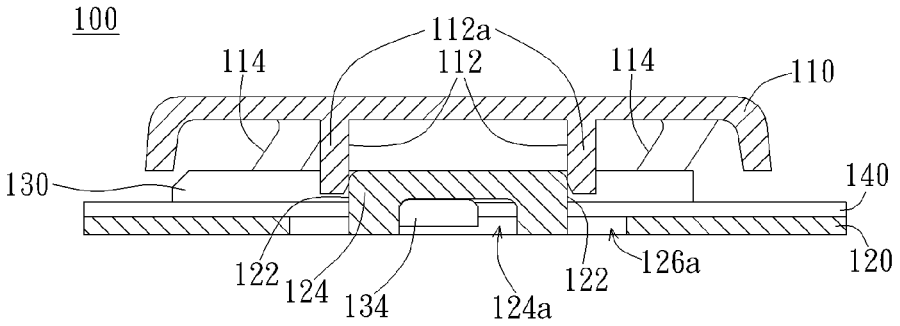
FIGS. 2A-2C are sectional views of the keyswitch structure along the lines A-A', B-B' and C-C' respectively in FIG. 1.
Figure 2B:
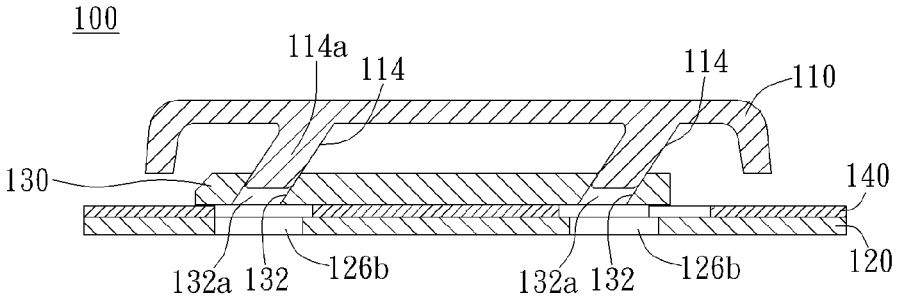
Figure 2C:
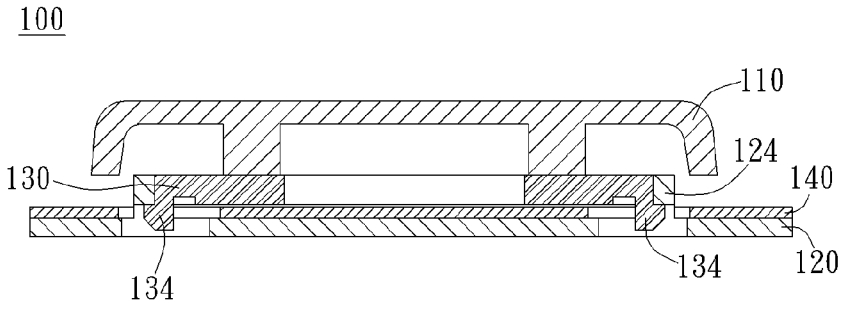

FIG. 1 is an exploded view of a keyswitch structure of the invention. FIG. 2A is a sectional view of the keyswitch structure after assembled along the line A-A' in FIG. 1. FIG. 2B is a sectional view of the keyswitch structure after assembled along the line B-B' in FIG. 1. FIG. 2C is a sectional view of the keyswitch structure after assembled along the line C-C' in FIG. 1. As shown by FIG. 1 and FIGS. 2A-2C, the keyswitch structure 100 of the invention includes a keycap 110, a baseplate 120, a slidable part 130, a switch layer 140, and a restoring member 150. In detail, in the keyswitch structure 100, the baseplate 120, the switch layer 140, the slidable part 130, and the keycap 110 are stacked in order from bottom to top, and the restoring member 150 is disposed at a side of the slidable part 130. Further, the keyswitch structure 100 of the invention includes a frame 160. The frame 160 has a key opening 162. The frame 160 is disposed to allow the keycap 110 to move in the key opening 162 along a Z axis (i.e. to move up and down relative to the baseplate 120). It is noticeable that although the embodiment is illustrated by the single keyswitch structure 100, for a keyboard having a plurality of the keyswitch structures 100, some components (such as the baseplate 120, the switch layer 140 or the frame 160) of the keyswitch structures 100 can be integrated into a single part for a benefit of cost reduction in production and assembly. In addition, for a simple illustration, the keyswitch structure 100 in FIGS. 2A-2C is shown without the restoring member 150 and the frame 160. For the disposition of the restoring member 150 and the frame 160 of the keyswitch structure 100, please refer to FIGS. 4A-4C.

In the embodiment, the keycap 110 is a substantially quadrilateral. Two extension directions of two adjacent sides (such as a first side 110*a* and a second side 110*b*) of the keycap 110 are defined as an X axis and a Y axis respectively. In other words, the first side 110*a* of the keycap 110 is substantially parallel to the X axis; the second side 110*b* of the keycap 110 is substantially parallel to the Y axis. The top surface of the keycap 110 is substantially parallel to an XY plane parallel to the X axis and the Y axis. The keycap 110 is used for receiving a pressing operation and can move toward the baseplate 120 in response to the pressing operation so that the keycap 110 can trigger the switch layer 140. As shown by FIGS. 2A-2C, the keycap 110 includes a first vertical connection member 112, and the baseplate 120 includes a second vertical connection member 122 correspondingly. The second vertical connection member 122 is engaged with the first vertical connection member 112 so that the keycap 110 is constrained to move relative to the baseplate 120 substantially along a Z axis. For example, the first vertical connection member 112 can preferably have a first contact surface extending parallel to the Z axis from the keycap 110 toward the baseplate 120 while the second vertical connection member 122 can preferably have a second contact surface extending parallel to the Z axis from the baseplate 120 toward the keycap 110. In the embodiment, the first vertical connection member 112 can be a post 112*a* extending parallel to the Z axis from an inside surface of the keycap 110 toward the baseplate 120. A side surface of the post 112*a* extending parallel to the Z axis can be regarded as the first vertical connection member 112. Corresponding to the first vertical connection member 112 of the keycap 110, the second vertical connection member 122 of the baseplate 120 can be the second contact surface extending parallel to the Z axis from a surface of the baseplate 120 toward the keycap 110. It is noticeable that the second contact surface of the vertical connection member 122 on the baseplate 120 can be (1) a side surface of an independent part protruding toward the keycap 110 or (2) a partial surface of one of components integrated to the baseplate 120, corresponding to the position of the first vertical connection member 112. In the embodiment, as shown by FIG. 2A, the second vertical connection member 122 is preferably a constraint portion 124 of the baseplate 120 while the second contact surface is preferably an end surface of the constraint portion 124, which will be described later.

Furthermore, as shown by FIG. 2B, the keycap 110 includes a first vertical-horizontal-translation mechanism 114, and the slidable part 130 includes a second vertical-horizontal-translation mechanism 132 correspondingly. The second vertical-horizontal-translation mechanism 132 is engaged with the first vertical-horizontal-translation mechanism 114 so that when the keycap 110 receives a pressing operation and moves relative to the baseplate 120 along the Z axis, the slidable part 130 performs a first motion in response to the movement of the keycap 110 toward the baseplate 120. Therein, the first motion at least includes a displacement in a positive direction of an X axis (e.g. the rightward direction of the drawing). For example, the first vertical-horizontal-translation mechanism 114 preferably includes a first slanted surface extending from the keycap 110 parallel to the Z axis while the second vertical-horizontal-translation mechanism 114 includes a second slanted surface corresponding to the first slanted surface. The first slanted surface slants relative to the baseplate 120. The first slanted surface movably abuts against the second slanted surface so that a vertical displacement of the keycap 110 along the Z axis and a horizontal displacement of the slidable part 130 along the X axis can be transferred to each other. In the embodiment, for the design of the slidable part 130 horizontally moving along the X axis, the first slanted surface and the second slanted surface cross with the XY plane and form a slanted angle therebetween. It is noticeable that a horizontal displacement of the slidable part 130 produced by a movement of the keycap 110 along the Z axis can be varied by modifying the slant angle of the first slanted surface and the second slanted surface.

Figure 3A:
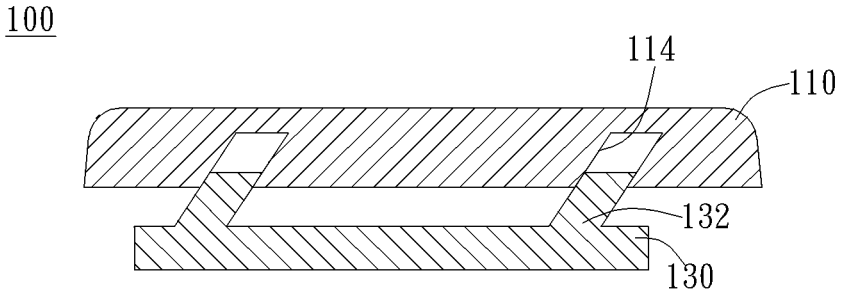
FIGS. 3A-3B are schematic diagrams illustrating a first vertical-horizontal-translation mechanism and a second vertical-horizontal-translation mechanism of other embodiments of the invention.
Figure 3B:
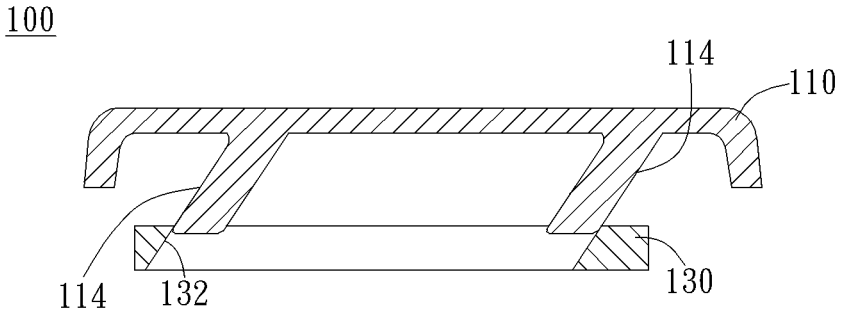

As shown by FIG. 2B, the first vertical-horizontal-translation mechanism 114 is preferably a slanted post 114*a* having a first slanted surface while the second vertical-horizontal-translation mechanism 132 is a slanted passage 132*a* having a second slanted surface corresponding to the first slanted surface. The slanted post 114*a* relatively moves in the slanted passage 132*a* so that a vertical displacement of the keycap 110 along the Z axis and a horizontal displacement of slidable part 130 along the X axis can be transferred to each other, which will be described in detail in the following. It is noticeable that in another embodiment, the dispositions of the slanted post and the slanted passage can be exchanged, or the first and second vertical-horizontal-translation mechanisms 114 and 132 can be provided in different types, as shown in FIGS. 3A-3B. Therein, FIGS. 3A-3B illustrate variants of the first vertical-horizontal-translation mechanism 114 of the keycap 110 and the second vertical-horizontal-translation mechanism 132 of the slidable part 130 only and omits the details of the other components. In FIG. 3A, the first vertical-horizontal-translation mechanism 114 of the keycap 110 includes a plurality of slanted passages while the second vertical-horizontal-translation mechanism 132 of the slidable part 130 includes a plurality of corresponding slanted posts. In FIG. 3B, the first vertical-horizontal-translation mechanism 114 of the keycap 110 includes a plurality of slanted posts while the second vertical-horizontal-translation mechanism 132 of the slidable part 130 is designed to be include a plurality of second slanted surfaces. In other words, the slidable part 130 can be designed in a form of a frame having an opening, of which the side walls at opposite sides can be used as corresponding second slanted surface.

Furthermore, the keyswitch structure 100 preferably includes a plurality of the first vertical-horizontal-translation mechanisms 114 and a plurality of the corresponding second vertical-horizontal-translation mechanisms 132, so that an applied force by the pressing operation can be dispersed for enhancing the stability of the keycap 110 moving relative to the baseplate 120. It is noticeable that if a plurality of the first and second vertical-horizontal-translation mechanisms 114 and 132, the slanted direction of every first and second vertical-horizontal-translation mechanisms 114 and 132 is the same. As shown by FIG. 1, the four of the second vertical-horizontal-translation mechanisms 132 are disposed at four corners of the slidable part 130 correspondingly; however, the invention is not limited thereto.

Further, the slidable part 130 includes an engagement portion 134 besides the second vertical-horizontal-translation mechanism 132. As shown by FIG. 1, FIG. 2A and FIG. 2C, the slidable part 130 is disposed between the keycap 110 and the baseplate 120. The engagement portion 134 preferably is a pair of hooks protruding from the slidable part 130 at two opposite sides of the slidable part 130 in the Y axis. Corresponding to the engagement portion 134 of the slidable part 130, the baseplate 120 preferably includes a pair of constraint portions 124 vertically disposed on a surface of the baseplate 120 and located at two opposite sides of the baseplate 120 (e.g. in the Y axis). In the embodiment, the baseplate 120 can be formed by a metal sheet or other conventional materials. For example, the constraint portion 124 can be a bent-up portion of a metal baseplate formed in one piece. Therein, the constraint portion 124 can be formed in a type of portal with a constraint hole 124*a* extending along the X axis. When the slidable part 130 is disposed on the baseplate 120, the engagement portion 134 of the slidable part 130 is movably engaged with the corresponding constraint portion 124; that is, the engagement portion 134 is accommodated in the constraint hole 124*a* and can move substantially within a movement range provided by the constraint hole 124*a*, so that the movement range of the slidable part 130 in the X axis is limited. Furthermore, as described above, the second vertical connection member 122 of the baseplate 120 can have the second contact surface extending from the surface of the baseplate 120 in the Z axis. In a preferred embodiment, two inside end surfaces of the constraint portion 124 in the X axis are used as the second vertical connection member 122 that constrains the keycap 110 to move relative to the baseplate 120 substantially along the Z axis. Further, when the slidable part 130 moves along the X axis, two opposite side surfaces 124*b* of the two constraint portions 124 in the Y axis can function as sliding guiding surfaces to the slidable part 130.

In the embodiment, the baseplate 120 can be designed to have a plurality of lift guiding holes 126*a* and a plurality of relief holes 126*b*. As shown in the figures, the lift guiding hole 126*a* is a through hole following the end surface of the constraint portion 124 functioning as the second vertical connection member 122 and is used for providing a space allowing the first vertical connection member 112 of the keycap 110 to move in when the first vertical connection member 112 moves toward the baseplate 120 (referring to FIG. 2A). The relief hole 126*b* is disposed corresponding to the second vertical-horizontal-translation mechanism 132 and is used for providing a space allowing the first vertical-horizontal-translation mechanism 114 of the keycap 110 to move in when the first vertical-horizontal-translation mechanism 114 moves toward the baseplate 120 (referring to FIG. 2B). Thereby, the keycap 110 can move down to a position where the keycap 110 substantially abuts against the switch layer 140.

Furthermore, for the design of the constraint portions 124, the lift guiding holes 126*a*, and the relief holes 126*b* of the baseplate 120, the switch layer 140 preferably has two windows 142 communicating with the lift guiding holes 126*a* and the relief holes 126*b* in the Z axis. That is, when the switch layer 140 is disposed on the baseplate 120, the constraint portion 124 extends through the window 142 toward the keycap 110 along the Z axis; the lift guiding holes 126*a* and the relief holes 126*b* are exposed in the windows 142.

Figure 4A:
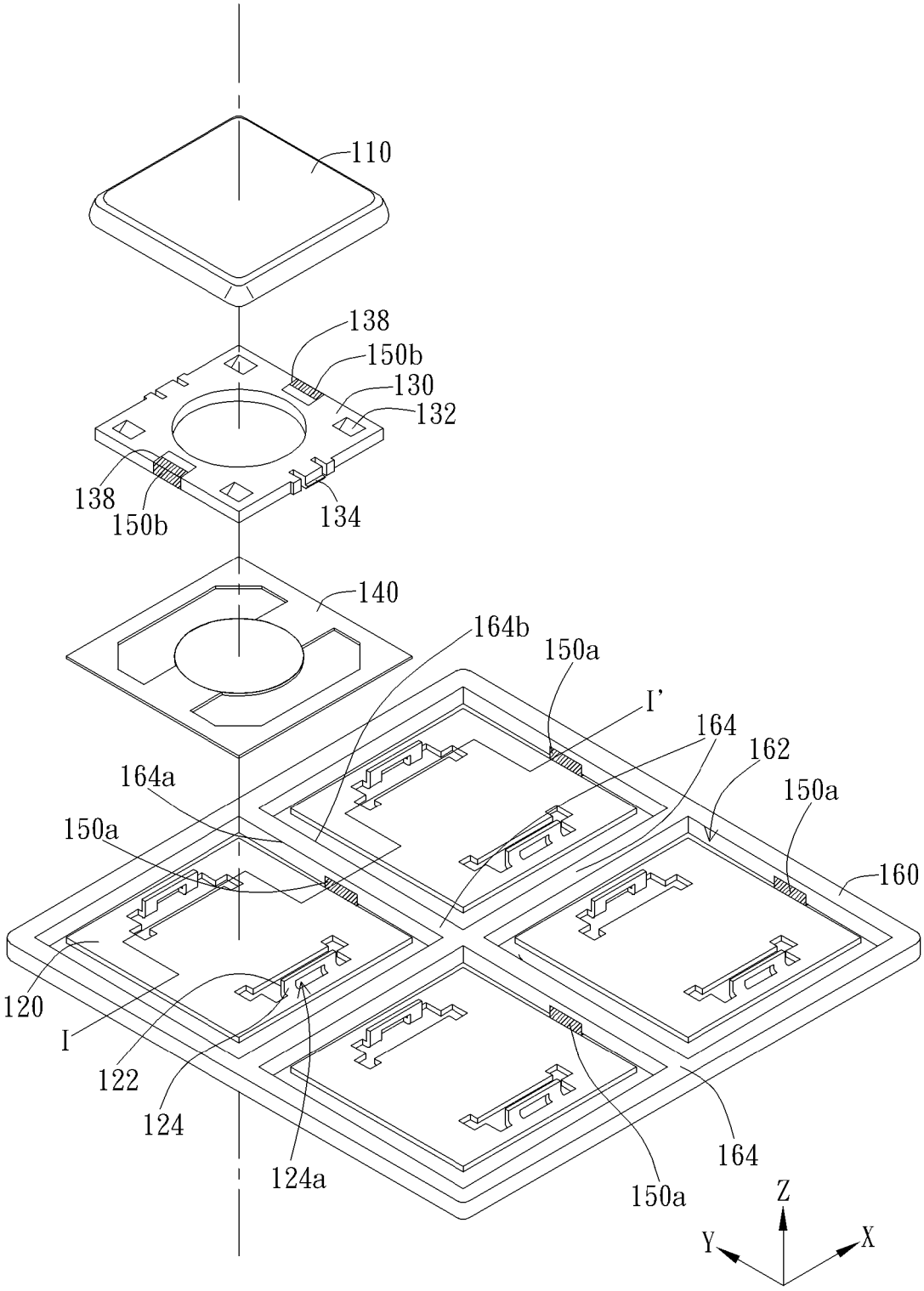
FIGS. 4A-4C are schematic diagrams illustrating the configuration of a frame and restoring members and the movement of a keyswitch structure of an embodiment of the invention.
Figure 4B:
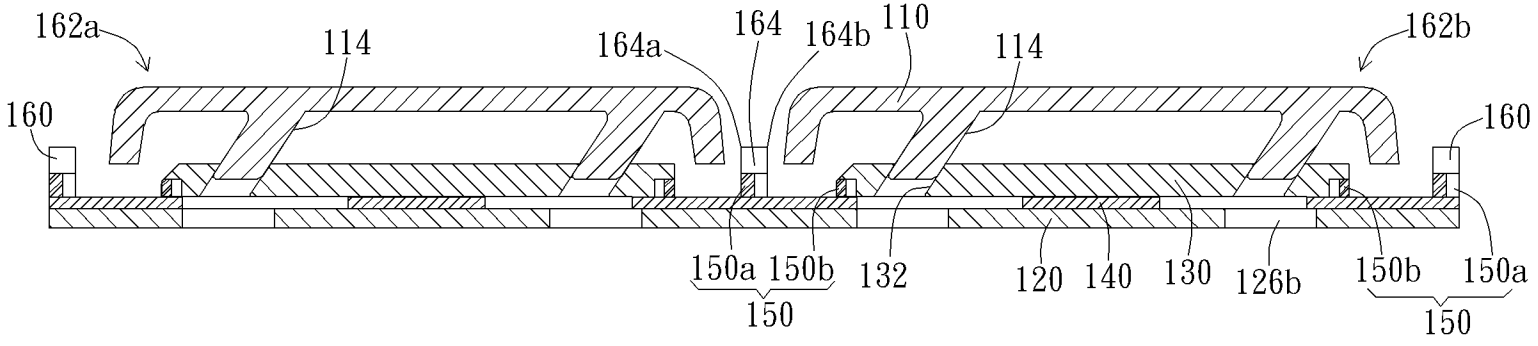
Figure 4C:
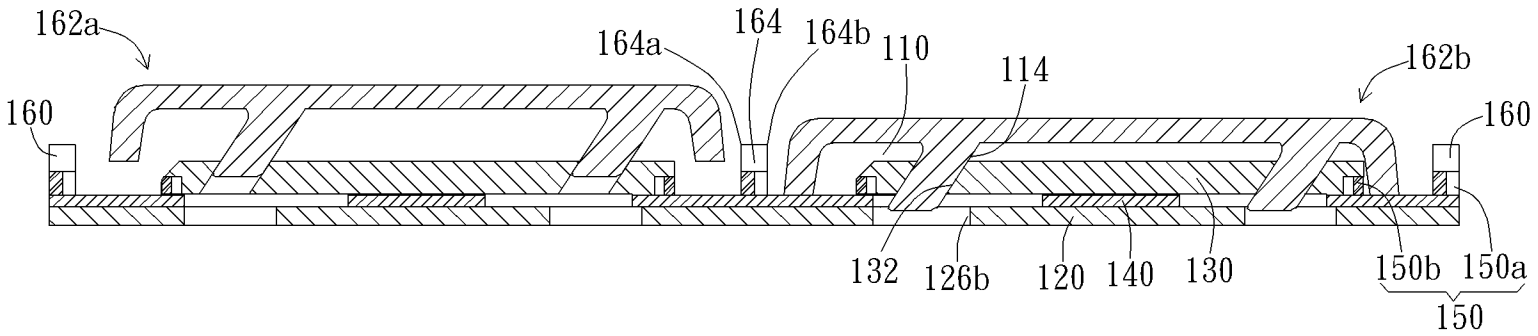

As shown by FIG. 1, the restoring member 150 is disposed at a side of the slidable part 130 and is used for providing a horizontal restoring force to the slidable part 130. When the pressing operation is discontinued, the horizontal restoring force makes the slidable part 130 perform a second motion. The second motion at least includes a displacement in a negative direction of the X axis (i.e. a reverse displacement in the positive direction) for driving the keycap 110 to move away from the baseplate 120 along the Z axis. In the embodiment, the restoring member 150 includes a plurality of magnetic parts 150*a* and 150*b* and uses magnetic force to drive the slidable part 130 to perform the second motion. As shown by FIG. 1, the restoring member 150 includes a first magnetic part 150*a* and a second magnetic part 150*b* disposed on corresponding sides of the frame 160 and the slidable part 130 respectively. Specifically, the first magnetic part 150*a* is preferably disposed on an inner side wall of the key opening 162 of the frame 160 corresponding to the second magnetic part 150*b* on the corresponding side of the slidable part 130, so that a magnetic force produced by the magnetic parts 150*a* and 150*b* can make the slidable part 130 move in the negative direction of the X axis when the pressing operation is discontinued, and the slidable part 130 then drives the keycap 110 to move away from the baseplate 120 along the Z axis. It is noticeable that the first magnetic part 150*a* and the second magnetic part 150*b* can directly adhere to corresponding side walls of the frame 160 and the slidable part 130 respectively, or the corresponding side walls of the frame 160 and the slidable part 130 can be designed to have accommodating portions at the places for disposing the first magnetic part 150*a* and the second magnetic part 150*b* therein so that the magnetic parts 150*a* and 150*b* are embedded in or adhere on the corresponding side walls of the frame 160 and the slidable part 130 respectively. In the embodiment, the frame 160 preferably has a first accommodating portion 168 by forming a depression on a bottom surface of the frame 160 toward a top surface of the frame 160 in a predetermined depth for accommodating the first magnetic part 150*a*. As shown by FIG. 1, the first accommodating portion 168 is an indentation at the bottom of the frame 160. The shape of the first accommodating portion 168 matches with the shape of the first magnetic part 150*a*, so that at least a part of the first magnetic part 150*a* can be embedded or adhere in the first accommodating portion 168 with a pole of the first magnetic part 150*a* facing an equivalent or different pole of the second magnetic part 150*b* on the slidable part 130. It is noticeable that when the first magnetic part 150*a* is disposed at the bottom of the frame 160, the first magnetic part 150*a* can be protrusive relative to the bottom surface of the frame 160 or be aligned with the bottom surface, depending on the thickness of the frame 160 along the Z axis; however, the invention is not limited thereto. Furthermore, similarly, the slidable part 130 preferably has a second accommodating portion 138 by forming a depression on a side surface of the slidable part 130 for accommodating the second magnetic part 150*b*. As shown by FIG. 1, the second accommodating portion 138 is an indentation at the side surface of the slidable part 130. The shape of the second accommodating portion 138 matches with the shape of the second magnetic part 150*b*, so that the second magnetic part 150*b* can be embedded or adhere in the second accommodating portion 138 with a pole of the second magnetic part 150*b* facing an equivalent or different pole of the first magnetic part 150*a* on the frame 160. In the embodiment, the second magnetic part 150*b* preferably is wholly accommodated in the second accommodating portion 138 so that the surface of the second magnetic part 150*b* and the surface of the slidable part 130 are coplanar. Based on the disposition of the first accommodating portion 168 and the second accommodating portion 138, a required disposition space for the restoring member 150 can be reduced greatly, which is also conducive to a reduction of the keyswitch structure in size. Referring to FIGS. 4A-4C, the following will describe the disposition of the poles of the magnetic parts 150*a* and 150*b* of the restoring member 150 according to the movement direction of the slidable part 130 by an embodiment.

FIG. 4A is a schematic diagram illustrating a plurality of the keyswitch structures 100 arranged in a matrix to form a keyboard. FIG. 4B and FIG. 4B are sectional views of the keyswitch structures 100 after assembled to form the keyboard along the line I-I' and illustrate the keyswitch structures 100 before and after receiving a pressing operation respectively. FIG. 4A illustrates the configuration of the magnetic parts 150*a* and 150*b* of the keyswitch structures 100. Therein, for simplifying the illustration, only one of the keyswitch structures 100 is shown; although the other keyswitch structures 100, it is understood that the keyswitch structures 100 also have the same structure. In the embodiment, the frame 160 has a plurality of key openings 162 (e.g. four) for accommodating the keyswitch structures 100 correspondingly. The first magnetic parts 150*a* are disposed on side walls of the key openings 162. For an example of the slidable part 130 moving along the X axis, a pair of the first magnetic parts 150*a* preferably are disposed on two face-to-face opposite side walls of the key opening 162 along the X axis. Furthermore, as shown by FIG. 4B, the frame 160 has two adjacent key openings along the X axis, for example a first key opening 162*a* and a second key opening 162*b*. The first key opening 162*a* and the second key opening 162*b* are disposed in a predetermined interval and have a first side wall 164*a* and a second side wall 164*b* respectively. In a preferred embodiment, the first magnetic part 150*a* is disposed at the bottom of the frame 160 so that two ends of the first magnetic part 150*a* are exposed out on the first side wall 164*a* and the second side wall 164*b* respectively. That is, the frame 160 uses a plurality of interlaced trusses 164 to forms the key openings 162*a* and 162*b*. The predetermined interval between the first key opening 162*a* and the second key opening 162*b* is the width of the truss 164 along the X axis. The first side wall 164*a* and the second side wall 164*b* are two opposite side walls of the truss 164. The first magnetic part 150*a* preferably is disposed so that the two opposite poles face the two adjacent key openings 162*a* and 162*b* respectively and interact with the second magnetic parts 150*b* on the two corresponding sides of the slidable part 130 to produce magnetic attraction force and magnetic repulsion force respectively.

For example, as shown by FIG. 4B, when the keycap 110 is not under a pressing operation, the restoring member 150 at the left side of the keyswitch structure 100 is located at a predetermined position by the magnetic attraction force. When the keycap 110 receives an pressing operation so that the magnetic attraction force is overcome and the keycap 110 moves toward the baseplate 120 substantially along the Z axis by the first contact surface (i.e. the first vertical connection member 112) relatively movably contacting the second contact surface (i.e. the second vertical connection member 122), by the first slanted surface (i.e. the first vertical-horizontal-translation mechanism 114) relatively movably abutting against the second slanted surface (i.e. the second vertical-horizontal-translation mechanism 132), the slidable part 130 is driven to move in the positive direction of the X axis (i.e. the right direction of the drawing) so that the switch layer 140 is triggered, as shown by FIG. 4C. When the pressing operation is discontinued, the restoring member 150 at the left side produces the magnetic attraction force while the restoring member 150 at the opposite side (i.e. the right side) produces the magnetic repulsion force, so that the slidable part 130 moves in the negative direction of the X axis (i.e. the left direction of the drawing) to drive the keycap 110 to move away from the baseplate 120 along the Z axis and back to the position where the keycap 110 is not loaded with the pressing operation. In the embodiment, all the first magnetic parts 150*a* and the left second magnetic part 150*b* of each keyswitch structure 100 can be disposed with the S pole at the left and the N pole at the right, so that the restoring member 150 at the left side of the keycap 110 provides a horizontal restoring force of magnetic attraction force to the slidable part 130. Furthermore, the right second magnetic part 150*b* of each keyswitch structure 100 can be disposed with the N pole at the left and the S pole at the right, so that the restoring member 150 at the left side of the keycap 110 provides a horizontal restoring force of magnetic repulsion force to the slidable part 130. In other words, when the first magnetic part 150*a* is disposed at the bottom of the frame 160 and the two poles of the first magnetic part 150*a* interact individually with the second magnetic parts 150*b* on the slidable parts 130 of the two keyswitch structures 100 adjacent to the first magnetic part 150*a*, all first magnetic parts 150*a* are disposed in the same pole direction, for example the S pole at the left and the N pole at the right. Corresponding to the configuration, the second magnetic parts 150*b* at the left and right sides of each slidable part 130 are disposed in a reverse pole direction, for example the S pole at the left and the N pole at the right for the second magnetic part 150*b* at the left side of the slidable part 130 while the N pole at the left and the S pole at the right for the second magnetic part 150*b* at the right side of the slidable part 130. It is noticeable that in other embodiments, the first magnetic part 150*a* can be disposed with the N pole at the left and the S pole at the right. The second magnetic parts 150*b* are correspondingly disposed with the N pole at the left and the S pole at the right for the left second magnetic parts 150*b* while the S pole at the left and the N pole at the right for the right second magnetic parts 150*b*. By the above configuration, the adjacent keyswitch structures 100 share one first magnetic part 150*a*, which is conducive to reduction in the quantity of the magnetic parts and to enhancement of assembly.

Figure 5:
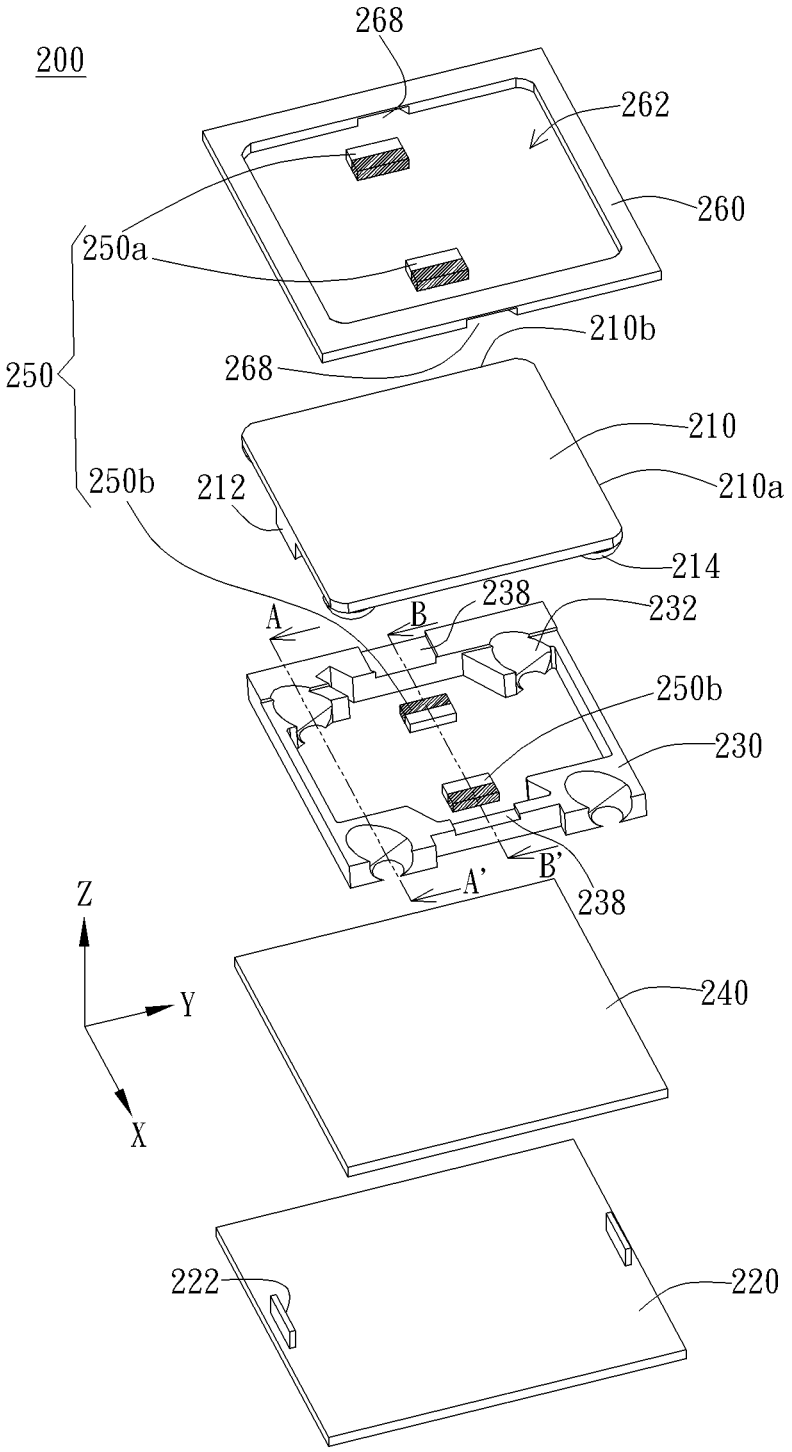
FIG. 5 is an exploded view of a keyswitch structure of another embodiment of the invention.

Furthermore, in other embodiments, by modifying the design of the first vertical-horizontal-translation mechanism and the second vertical-horizontal-translation mechanism, the first motion of the slidable part can have a displacement in the positive direction of the X axis and a displacement in the positive direction of the Y axis, and the second motion can have a displacement in the negative direction of the X axis and a displacement in the negative direction of the Y axis. As shown by FIG. 5, in another embodiment, a keyswitch structure 200 includes a keycap 210, a baseplate 220, a slidable part 230, a switch layer 240, a restoring member 250, and a frame 260. Therein, the components of the keyswitch structure 200 are similar to the components of the keyswitch structure 100. The difference between the keyswitch structure 200 and the keyswitch structure 100 is mainly the design of the first vertical-horizontal-translation mechanism 214 and the second vertical-horizontal-translation mechanism 232. Therefore, the following description will focus mainly on the difference between the keyswitch structure 200 and the keyswitch structure 100. The similar structures and connection relationship can refer to the relational description in the above embodiments. In the embodiment, the first vertical-horizontal-translation mechanism 214 has a first curved surface while the second vertical-horizontal-translation mechanism 232 has a second curved surface. The first curved surface keeps contacting the second curved surface. When the keycap 210 receives a pressing operation and moves toward the baseplate 220 along the Z axis, the first motion of the slidable part 230 has a displacement in the positive direction of the X axis and a displacement in the positive direction of the Y axis. When the pressing operation is discontinued, the second motion of the slidable part 230 has a displacement in the negative direction of the X axis and a displacement in the negative direction of the Y axis. Specifically, similar to the keycap 110, the keycap 210 is a substantially quadrilateral. The keycap 210 has a first side 210*a* and a second side 210*b* adjacent to the first side 210*a*. The X axis is substantially parallel to the first side 210*a* of the keycap 210 while the Y axis is substantially parallel to the second side 210*b* of the keycap 210. In the embodiment, the first curved surface and the second curved surface are a curved convex surface and a curved concave surface respectively. The radius of curvature of the curved convex surface is smaller than the radius of curvature of the curved concave surface. That is, the first vertical-horizontal-translation mechanism 214 of the keycap 210 can be curved protrusions such as spheres or other shaped objects with a curved surface (e.g. spherical surface) located close to four corners of the keycap 210. The second vertical-horizontal-translation mechanism 232 of the slidable part 230 can be curved recesses located correspondingly under the positions where the first vertical-horizontal-translation mechanism 214 is located. If the radius of curvature of the curved convex surface is smaller than the radius of curvature of the curved concave surface, the first vertical-horizontal-translation mechanism 214 keeps contacting the second vertical-horizontal-translation mechanism 232 within a longer curve. Relatively, when the radius of curvature of the curved convex surface is much smaller than the radius of curvature of the curved concave surface, the first vertical-horizontal-translation mechanism 214 keeps contacting the second vertical-horizontal-translation mechanism 232 within a shorter curve. By such design, the contact area of the curved convex surface with the curved concave surface is quite small and the frictional force is small accordingly, so the smoothness of the pressing operation is improved. Further, because of the curved surface design of the first vertical-horizontal-translation mechanism 214 and the second vertical-horizontal-translation mechanism 232, the slidable part 230 can perform horizontal and slanted movement; that is, the slidable part 230 has a displacement along each of the X axis and the Y axis. Further, for minimizing the required space for disposing the restoring member 250, the frame 260 and the slidable part 230 preferably has a first accommodating portion 268 and a second accommodating portion 238 for accommodating the first magnetic part 250*a* and the second magnetic part 250*b* respectively. The details thereof are similar to those described in the embodiment shown by FIG. 1 and will not be repeated.

Figure 6A:
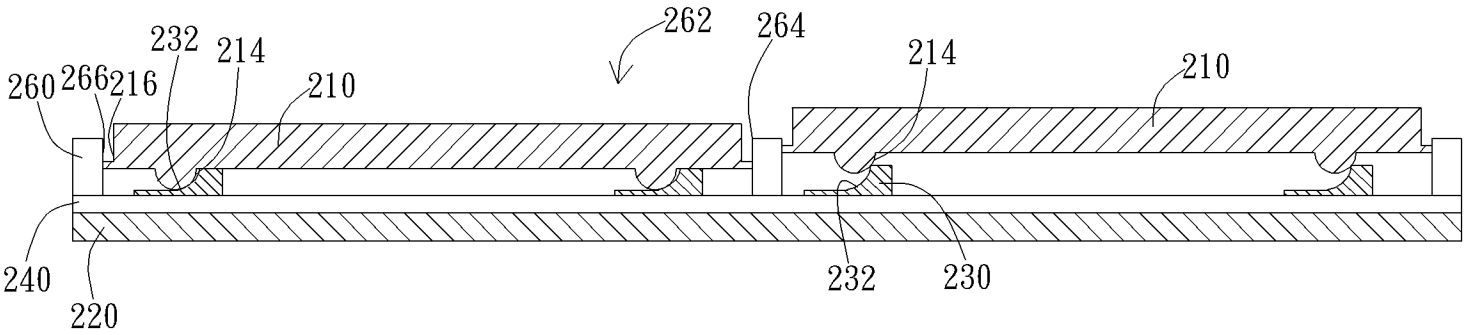
FIGS. 6A-6B are schematic diagrams illustrating the configuration of a frame and restoring members and the movement of a keyswitch structure of another embodiment of the invention.
Figure 6B:
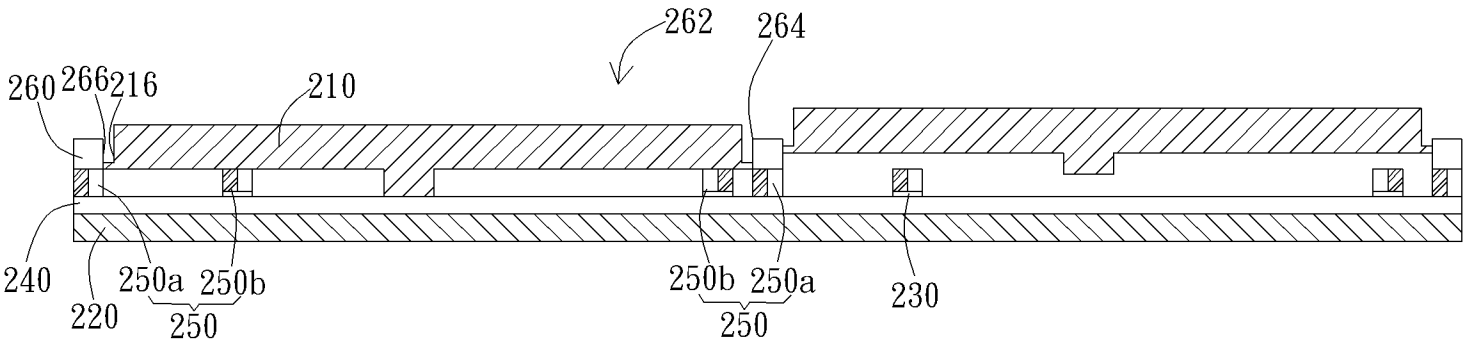

In FIGS. 6A-6B, the keyswitch structure 200 is illustrated in a sectional view along the X axis. The first curved surface and the second curved surface are illustrated showing that when the keycap 210 moves toward the baseplate 220, the slidable part 130 moves right relative to the drawing along the X axis. FIG. 6A is a schematic diagram illustrating the first and second vertical-horizontal-translation mechanisms along the line A-A' in FIG. 5. FIG. 6 is a schematic diagram illustrating the first and second magnetic parts along the line B-B' in FIG. 5. Furthermore, for convenience of illustrating the pole dispositions of the first and second magnetic parts and the movement of the keyswitch structure, two adjacent keyswitch structures are illustrated in an un-pressed status (the right one) and a pressed status (the left one) respectively. In the embodiment, the disposition of the restoring member 250 is the same as the restoring member 150 shown by FIGS. 4B-4C. That is, the restoring member 250 includes a plurality of first magnetic parts 250*a* and a plurality of corresponding second magnetic parts 250*b* disposed on at corresponding sides of the frame 260 and the slidable part 230 along the X axis respectively. As described above, the adjacent keyswitch structures 200 are designed to share the same first magnetic part 250*a*. When the first magnetic part 250*a* is disposed at the bottom of the frame 260 and the two poles of the first magnetic part 250*a* interact individually with the second magnetic parts 250*b* on the slidable parts 230 of the two keyswitch structures 200 adjacent to the first magnetic part 250*a*, all first magnetic parts 250*a* are disposed in the same pole direction, for example the S pole at the left and the N pole at the right. Corresponding to the configuration, the second magnetic parts 250*b* at the left and right sides of each slidable part 230 are disposed in a reverse pole direction (for example the S pole at the left and the N pole at the right for the second magnetic part 250*b* at the left side of the slidable part 230 while the N pole at the left and the S pole at the right for the second magnetic part 250*b* at the right side of the slidable part 230).

When the keycap 210 receives a pressing operation and moves toward the baseplate 220 along the Z axis, the first vertical-horizontal-translation mechanism 214 (e.g. a curved convex surface) slides down along the second vertical-horizontal-translation mechanism 232 (e.g. a curved concave surface) to drive the slidable part 230 to move so that the slidable part 230 has a horizontal displacement in the positive direction of the X axis and a horizontal displacement in the positive direction of the Y axis. Thereby, the keycap 210 moves down along the Z axis to abut against the switch layer 240. When the pressing operation is discontinued, the restoring member 250 (e.g. magnetic parts 250*a* and 250*b*) at the left side produces a magnetic attraction force while the restoring member 250 (e.g. magnetic parts 250*a* and 250*b*) at the opposite side (i.e. the right side) produces a magnetic repulsion force, so that the slidable part 230 moves in the negative direction of the X axis and in the negative direction of the Y axis to drive the keycap 210 to move away from the baseplate 220 along the Z axis and back to the position where the keycap 210 is not loaded with the pressing operation.

It is noticeable that a first vertical connection member 212 and a second vertical connection member 222 also can be disposed at corresponding positions of the keycap 210 and the baseplate 220 respectively so that the keycap 210 is constrained to move relative to the baseplate 220 substantially along the Z axis; that is, the keycap 210 can move relative to the baseplate 220 only up and down vertically. In the embodiment, similar to the configuration shown by FIG. 1 and FIG. 2A, the first vertical connection member 212 and the second vertical connection member 222 can be contact surfaces which extend from the keycap 210 and the baseplate 220 respectively toward each other along the Z axis and are movable relatively. Furthermore, as shown by FIGS. 6A-6B, the frame 260 further includes a first positioning portion 266 facing a key opening 262 of the frame 260. Correspondingly, the keycap 210 further includes a second positioning portion 216 slidably coupled to the first positioning portion 266. When the keycap 210 moves along the Z axis, the second positioning portion 216 moves relative to the first positioning portion 266. For example, the first positioning portion 266 can be a guiding slot formed on a side wall 264 of the key opening 262 of the frame 26 while the second positioning portion 216 can be a guiding post protruding corresponding to the side wall 264 from the keycap 210 toward the frame 260. Therein, the guiding slot has a predetermined length along the Z axis so that the guiding post of the keycap 210 has a predetermined movement range in the guiding slot so as to constrain a movement range of the keycap 210 along the Z axis. In the embodiment, because of the disposition of the first positioning portion 266 of the frame 260 and the second positioning portion 216 of the keycap 210, the keycap 210 is constrained to move relative to the baseplate 220 along the Z axis.

Figure 7A:
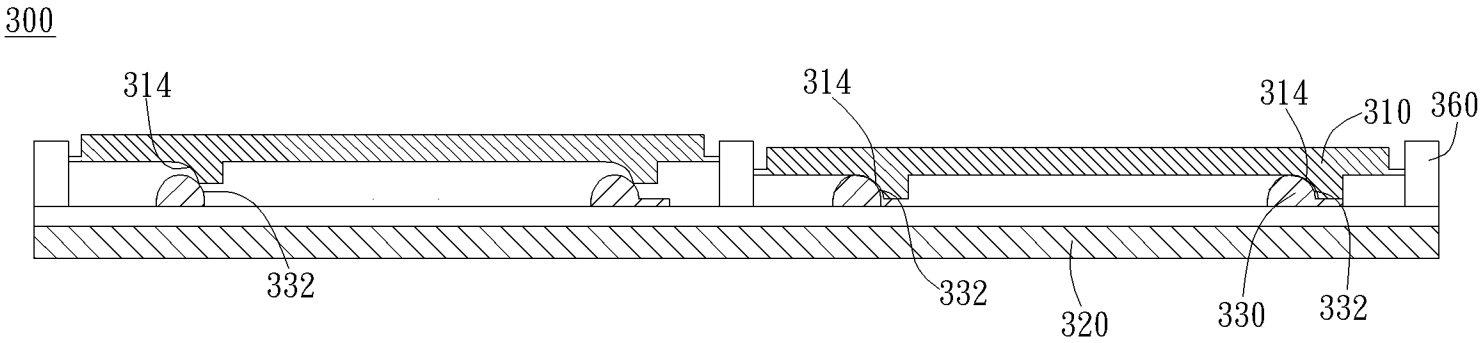
FIGS. 7A-7B are schematic diagrams illustrating the configuration of a frame and restoring members and the movement of a keyswitch structure of another embodiment of the invention.
Figure 7B:
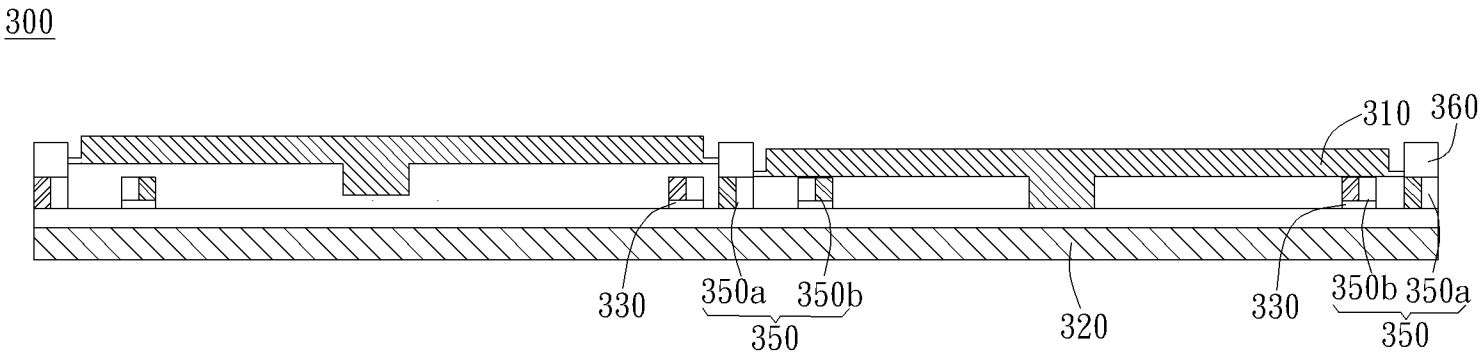

Furthermore, in other embodiments, the curved convex surface and the curved concave surface can be swapped. As shown by FIGS. 7A-7B, the first vertical-horizontal-translation mechanism 314 has a curved concave surface while the second vertical-horizontal-translation mechanism 332 has a corresponding curved convex surface. The radius of curvature of the curved convex surface is smaller than the radius of curvature of the curved concave surface. The function of the curved convex surface and the curved concave surface is similar to the above description about the curved convex surface and the curved concave surface and will not be repeated herein. It is noticeable that for convenient illustration, FIGS. 7A-7B are illustrated in the same way as FIGS. 6A-6B (i.e. the left one illustrated in an un-pressed status and the right one illustrated in a pressed status). In the keyswitch structures 300 in FIGS. 7A-7B, the orientation of the curved concave surface is reverse to that in FIGS. 6A-6B, so the horizontal direction in which the slidable part 330 is driven to move in response to a movement of the keycap 310 toward the baseplate 320 along the Z axis upon a pressing operation applied on the keycap 310 is reverse. For example, the positive direction of the X axis is from the left to the right, not from the right to the left; the disposition of the restoring member 350 needs to be modified accordingly. For an example, all the first magnetic parts 350*a* and the right second magnetic parts 350*b* of each keyswitch structure 300 can be disposed with the S pole at the left and the N pole at the right, so that the restoring member 350 at the right side of the keycap 110 provides a horizontal restoring force of magnetic attraction force to the slidable part 330. Furthermore, the right second magnetic part 150*b* of each keyswitch structure 100 can be disposed with the N pole at the left and the S pole at the right, so that the restoring member 350 at the left side of the keycap 310 provides a horizontal restoring force of magnetic repulsion force to the slidable part 330. In other words, when the first magnetic part 350*a* is disposed at the bottom of the frame 360 and the two poles of the first magnetic part 350*a* interact individually with the second magnetic parts 350*b* on the slidable parts 330 of the two keyswitch structures 300 adjacent to the first magnetic part 350*a*, all first magnetic parts 350*a* are disposed in the same pole direction, for example the S pole at the left and the N pole at the right. Corresponding to the configuration, the second magnetic parts 350*b* at the left and right sides of each slidable part 330 are disposed in a reverse pole direction, for example the S pole at the left and the N pole at the right for the second magnetic part 350*b* at the left side of the slidable part 330 while the N pole at the left and the S pole at the right for the second magnetic part 350*b* at the right side of the slidable part 330.

Figure 8A:
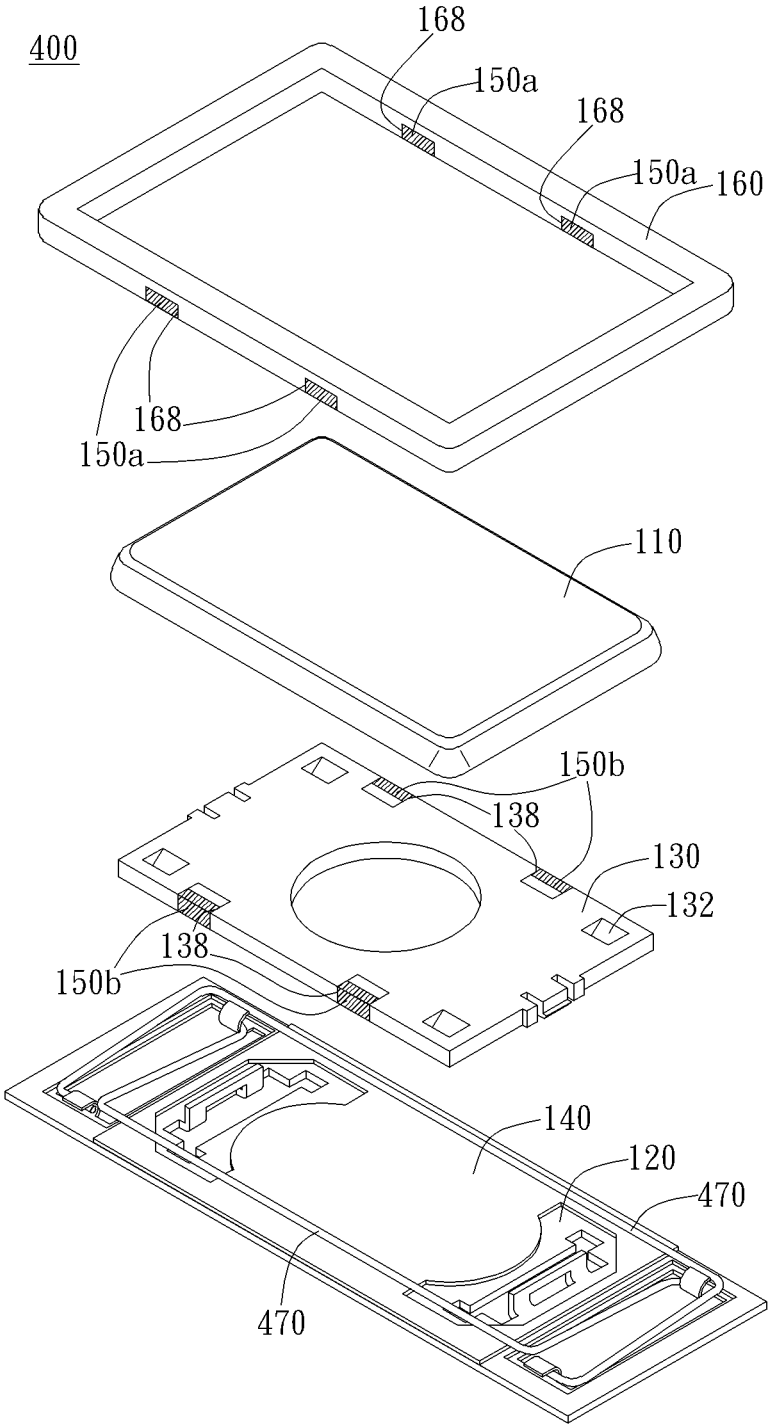
FIGS. 8A-8C are schematic diagrams illustrating a keyswitch structure of another embodiment of the invention.
Figure 8B:
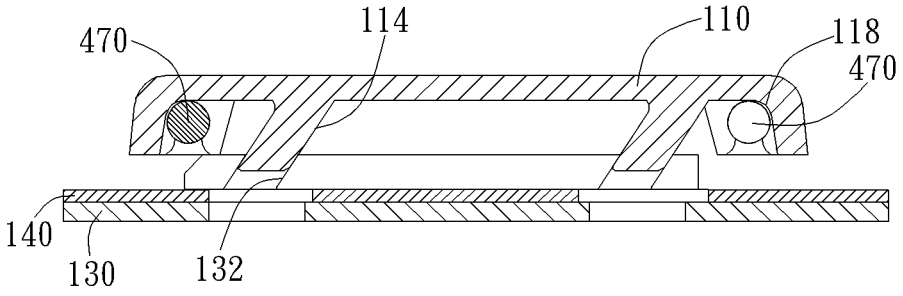
Figure 8C:
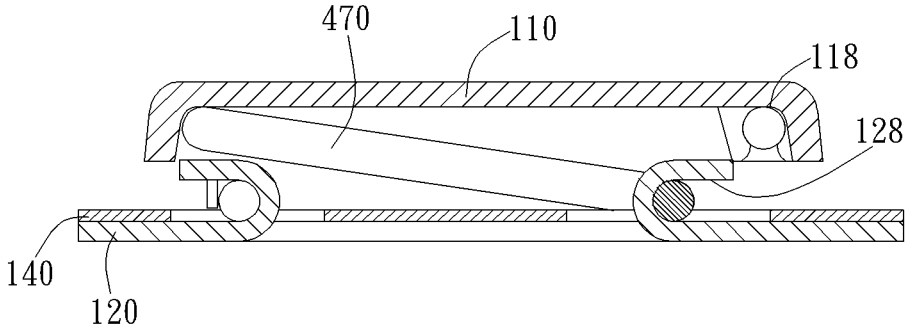

Furthermore, when the keyswitch structure of the invention is applied in large scale, the keyswitch structure can be provided with a baring mechanism for improving of the movement stability. In an embodiment, as shown FIGS. 8A-8C, a keyswitch structure 400 further includes at least one link 470 rotatably connected to the keycap 110 and the baseplate 120 so that the keycap 110 moves stably along the Z axis with keeping being parallel to the XY plane parallel to the X axis and the Y axis. The keyswitch structure 400 has a length along the Y axis larger than that of the keyswitch structure 100 in FIG. 1. In addition, in the keyswitch structure 400, the other components, such as the first and second vertical connection members 112 and 212 and the first and second vertical-horizontal-translation mechanisms 114 and 132, having the same function are labeled by the same notation; the description thereof is not repeated herein. In the embodiment, corresponding to the disposition of the link 470, the keycap 110 further includes first bearing and engaging portions 118 while the baseplate 120 includes second bearing and engaging portions 128. The second bearing and engaging portions 128 of the baseplate 120 are preferably disposed at two opposite sides along the Y axis outside the constraint portions 124. Two ends of the link 470 connected to the first bearing and engaging portions 118 of the keycap 110 and the second bearing and engaging portions 128 of the baseplate 120 respectively. In the embodiment, the link 470 is rotatably connected to the first bearing and engaging portion 118 of the keycap 110 (referring to FIG. 8B); the link 470 is movably connected to the second bearing and engaging portions 128 of the baseplate 120 (referring to FIG. 8C). When the keycap 110 vertically moves relative to the baseplate 120 along the Z axis, the link 470 horizontally moves along the X axis correspondingly so that the keycap 110 can move up and down with keeping being parallel to the XY plane under the constraint by the first vertical-horizontal-translation mechanism 114 and the second vertical-horizontal-translation mechanism 132. Further, the keycap 110 which has a larger size along the Y axis can be move up and down more stable under the supporting by the link 460. In addition, by modifying the design of corresponding components (e.g. the keycap 210 and the baseplate 220), the keyswitch structure 200 in FIG. 5 also can be provided with a link for being applied to a larger-size keyswitch structure, which will not be described herein.

Compared to the conventional keyswitch structure, the keyswitch structure of the invention uses the engagement of the first and second vertical connection member so that the keycap can move vertically substantially along the Z axis, which fits user's pressing habits. Furthermore, the keyswitch structure of the invention uses the engagement of the first and second vertical-horizontal-translation mechanism so that a vertical displacement of the keycap along the Z axis and a horizontal displacement of the slidable part along the XY plane can be transferred to each other. The height of the keyswitch structure can be controlled effectively by determining the thickness of the slidable part so that the keyswitch structure can be lighter and thinner. In addition, the keyswitch structure of the invention uses the restoring member to avoid the disposition of a conventional resilient member so that the keyswitch structure can be simplified in structure and reduced in size effectively.

Those skilled in the art will readily observe that numerous modifications and alterations of the device and method may be made while retaining the teachings of the invention. Accordingly, the above disclosure should be construed as constrained only by the metes and thresholds of the appended claims.

What is claimed is:

1. A keyswitch structure, comprising:

a keycap for receiving a pressing operation, the keycap comprising a first vertical connection member and a first vertical-horizontal-translation mechanism;

a baseplate disposed beneath the keycap, the baseplate comprising a second vertical connection member, the second vertical connection member engaged with the first vertical connection member so that the keycap is constrained to move relative to the baseplate substantially along a Z axis;

a slidable part disposed between the keycap and the baseplate, the slidable part comprising a second vertical-horizontal-translation mechanism, the second vertical-horizontal-translation mechanism engaged with the first vertical-horizontal-translation mechanism so that the slidable part performs a first motion in response to a movement of the keycap toward the baseplate upon the pressing operation, the first motion comprising a displacement in a first direction;

a restoring member disposed at a side of the slidable part, the restoring member providing at least a horizontal restoring force to the slidable part, when the pressing operation is discontinued, the horizontal restoring force enabling the slidable part to perform a second motion, the second motion comprising a displacement in a second direction to move the keycap away from the baseplate, the second direction being opposite to the first direction; and a frame, wherein the restoring member comprises a first magnetic part and a second magnetic part, the second magnetic part is disposed on the slidable part, and the first magnetic part is disposed on the frame.

2. The keyswitch structure of claim 1, wherein the first vertical-horizontal-translation mechanism comprises a first slanted surface, the second vertical-horizontal-translation mechanism comprises a second slanted surface, and the first slanted surface movably abuts against the second slanted surface, so that the movement of the keycap toward the baseplate can drive the slidable part to move toward the first direction, or a movement of the slidable part toward the second direction can drive the keycap to move away from the baseplate.

3. The keyswitch structure of claim 1, wherein the first vertical-horizontal-translation mechanism comprises at least one slanted passage or at least one slanted post, the second vertical-horizontal-translation mechanism correspondingly comprises the at least one slanted post or the at least one slanted passage, the slanted post corresponds to the slanted passage, and the slanted post relatively moves in the slanted passage.

4. The keyswitch structure of claim 1, wherein the restoring member comprises a plurality of magnetic parts, and magnetic force between the magnetic parts drives the slidable part to perform the second motion.

5. The keyswitch structure of claim 1, wherein the first vertical connection member has a first contact surface extending from the keycap substantially along the Z axis, the second vertical connection member has a second contact surface, and when the keycap moves substantially along the Z axis, the first contact surface keeps movably contacting the second contact surface.

6. The keyswitch structure of claim 1, further comprising a switch layer, wherein the switch layer is disposed between the slidable part and the baseplate, and the switch layer is used for enabling the keyswitch structure in response to the pressing operation on the keycap.

7. The keyswitch structure of claim 1, wherein the first vertical-horizontal-translation mechanism comprises a first curved surface, the second vertical-horizontal-translation mechanism comprises a second curved surface, and the first curved surface keeps contacting the second curved surface.

8. The keyswitch structure of claim 7, wherein one of the first curved surface and the second curved surface is a curved convex surface, the other one of the first curved surface and the second curved surface is a curved concave surface, and the radius of curvature of the curved convex surface is smaller than the radius of curvature of the curved concave surface.

9. The keyswitch structure of claim 1, wherein the baseplate comprises a constraint portion, the slidable part comprises an engagement portion movably engaged with the constraint portion so that the constraint portion defines a movement range of the slidable part along the first and second directions.

10. The keyswitch structure of claim 9, wherein the keycap has a first contact surface as the first vertical connection member, the constraint portion has a second contact surface as the second vertical connection member, the second contact surface extends toward the keycap substantially along the Z axis, and when the keycap moves substantially along the Z axis, the first contact surface keeps movably contacting the second contact surface.

11. The keyswitch structure of claim 1, wherein the keycap is a substantial quadrilateral, the keycap has a first edge and a second edge adjacent to the first edge, an X axis is substantially parallel to the first edge of the keycap, a Y axis is substantially parallel to the second edge of the keycap, when the keycap receives the pressing operation so that the keycap moves toward the baseplate along the Z axis, the first motion comprises the displacement in a positive direction of the X axis and a displacement in a positive direction of the Y axis, when the pressing operation is discontinued, the second motion comprises the displacement in a negative direction of the X axis and a displacement in a negative direction of the Y axis, the negative direction of the X axis and the positive direction of the X axis being opposite directions along the X axis, and the negative direction of the Y axis and the positive direction of the Y axis being opposite directions along the Y axis.

12. The keyswitch structure of claim 11, wherein the restoring member comprises a plurality of magnetic parts, and magnetic force between the magnetic parts drives the slidable part to perform the second motion.

13. The keyswitch structure of claim 11, further comprising at least one a link, the link being rotatably connected to the keycap and the baseplate so that the keycap is maintained parallel to an XY plane during the keycap moving along the Z axis, the XY plane being parallel to the X axis and the Y axis.

14. The keyswitch structure of claim 1, wherein the frame has a first key opening, the first key opening is enclosed by a first side wall, the keycap moves toward or away from the baseplate in the first key opening, the first magnetic part has a first end and a second end, and the first end is exposed out on the first side wall.

15. The keyswitch structure of claim 14, wherein the frame further has a second key opening, the second key opening is enclosed by a second side wall, the first key opening is next to the second key opening, and the second end is exposed out on the second side wall.

16. The keyswitch structure of claim 14, wherein the frame further comprises a first positioning portion facing the first key opening, the keycap further comprises a second positioning portion slidably coupled to the first positioning portion, and when the keycap moves toward or away from the baseplate, the second positioning portion moves relative to the first positioning portion.

* * * * *